US009828207B2

(12) United States Patent
Heckendorff

(10) Patent No.: US 9,828,207 B2
(45) Date of Patent: Nov. 28, 2017

(54) WINDING MATERIAL GUIDE DEVICE

(71) Applicant: Dietze & Schell Maschinenfabrik GmbH & Co. KG, Coburg (DE)

(72) Inventor: Andreas Heckendorff, Anhorn (DE)

(73) Assignee: Dietze & Schell Maschinenfabrik GmbH & Co. KG, Coburg (DE)

( * ) Notice: Subject to any disclaimer, the term of this patent is extended or adjusted under 35 U.S.C. 154(b) by 0 days.

(21) Appl. No.: 15/531,507

(22) PCT Filed: Dec. 1, 2015

(86) PCT No.: PCT/EP2015/078217
§ 371 (c)(1),
(2) Date: May 30, 2017

(87) PCT Pub. No.: WO2016/087443
PCT Pub. Date: Jun. 9, 2016

(65) Prior Publication Data

US 2017/0267484 A1 Sep. 21, 2017

(30) Foreign Application Priority Data

Dec. 2, 2014 (DE) ..... 10 2014 117 678

(51) Int. Cl.
*B65H 54/28* (2006.01)
*B65H 57/24* (2006.01)

(52) U.S. Cl.
CPC ..... *B65H 54/2839* (2013.01); *B65H 54/2821* (2013.01); *B65H 57/24* (2013.01)

(58) Field of Classification Search
CPC ..... B65H 57/24; B65H 54/2821; B65H 54/2824; B65H 54/2839; B65H 54/2836
See application file for complete search history.

(56) References Cited

U.S. PATENT DOCUMENTS 2,955,772 A 10/1960 Case
3,094,292 A 6/1963 Hebberling
(Continued)

FOREIGN PATENT DOCUMENTS

DE 2202852 A1 8/1973
DE 2321482 A1 11/1973
(Continued)

OTHER PUBLICATIONS

Search Report dated Sep. 24, 2015 issued in corresponding DE patent application No. 10 2014 117 678.2 (and partial English translation).

(Continued)

*Primary Examiner* — William E Dondero
(74) *Attorney, Agent, or Firm* — Posz Law Group, PLC

(57) ABSTRACT

A guiding device for a material to be wound for a winding machine includes at least one blade guiding unit comprising two fiber guiding blades, which are rotationally drivable in opposite directions and are configured for feeding a material to be wound to a carrier of material to be wound of the winding machine, and the at least one blade guiding unit is configured for conveying a material to be wound which is implemented of inorganic fibers.

Figure 1:
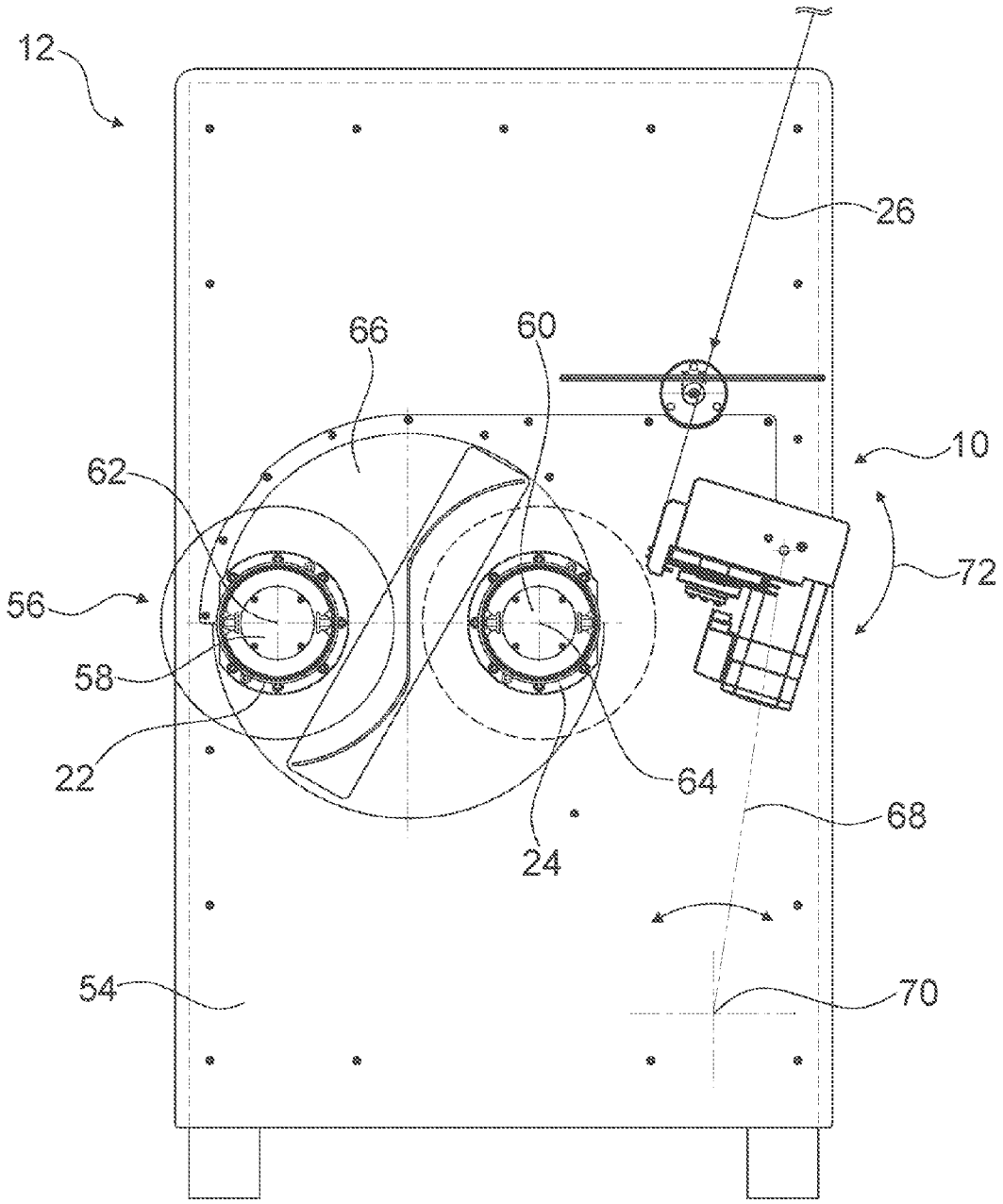

The blade guiding unit comprises at least one fiber guiding blade tip, which has an at least semi-oval exterior geometry, and the blade guiding unit comprises at least one fiber directing element, which is implemented at least partly of an inorganic-fiber compatible material and comprises at least one rounded fiber guiding edge.

11 Claims, 4 Drawing Sheets

(56) References Cited

U.S. PATENT DOCUMENTS

| | | | |
|---|---|---|---|
| 3,845,912 | A | 11/1974 | Eichmanns et al. |
| 5,607,115 | A | 3/1997 | Frech |
| 5,624,081 | A | 4/1997 | Turk et al. |
| 6,045,083 | A | 4/2000 | Mann et al. |
| 2008/0203214 | A1 | 8/2008 | Naulet et al. |

FOREIGN PATENT DOCUMENTS

| | | | |
|---|---|---|---|
| DE | 3302962 | A1 | 8/1984 |
| DE | 3417457 | A1 | 11/1985 |
| DE | 3516475 | A1 | 11/1985 |
| DE | 3703731 | A1 | 8/1987 |
| DE | 102006024061 | A1 | 1/2007 |
| DE | 202010008846 | U1 | 12/2010 |
| EP | 0117415 | A1 | 9/1984 |
| EP | 0622324 | A1 | 11/1994 |
| WO | 9414694 | A1 | 7/1994 |
| WO | 97/29037 | A1 | 8/1997 |
| WO | 02/08106 | A2 | 1/2002 |

OTHER PUBLICATIONS

International Search Report of the International Searching Authority dated Mar. 24, 2016 issued in corresponding International Patent Application No. PCT/EP2015/078217.

International Preliminary Report on Patentability dated Jun. 8, 2017 issued in corresponding International Patent Application No. PCT/EP2015/078217 (and German version of Mar. 10, 2017 with Article 34 amendments).

WINDING MATERIAL GUIDE DEVICE

CROSS REFERENCE TO RELATED APPLICATIONS

This application is a U.S. national stage application of PCT/EP2015/078217 filed on Dec. 1, 2015, which claims priority to German Patent Application No. DE 10 2014 117 678.2 filed on Dec. 2, 2014, the contents of which are incorporated herein by reference.

STATE OF THE ART

The invention relates to a guiding device for a material to be wound.

From U.S. Pat. No. 3,094,292 A and U.S. Pat. No. 2,955,772 A, guiding devices for a material to be wound for winding machines are already known, which have a blade guiding unit with two fiber guiding blades which are rotationally drivable in opposite directions and are configured for feeding a material to be wound consisting of organic fibers to a carrier of material to be wound of the winding machine.

Furthermore, from WO 94/14694 A1 a guiding device for a material to be wound for a winding machine is known, which has a blade guiding unit with two fiber guiding blades which are rotationally drivable in opposite directions and are configured for feeding a material to be wound to a carrier of material to be wound of the winding machine.

The objective of the invention is, in particular, to provide a generic guiding device for a material to be wound having improved characteristic in regard to a guiding of inorganic fibers.

ADVANTAGES OF THE INVENTION

The invention is based on a guiding device for a material to be wound for a winding machine, with at least one blade guiding unit comprising two fiber guiding blades which are rotationally drivable in opposite directions and are configured for feeding a material to be wound to a carrier of material to be wound of the winding machine, wherein the at least one blade guiding unit is configured for conveying a material to be wound which is implemented of inorganic fibers.

It is proposed that the blade guiding unit comprises at least one fiber guiding blade tip, which has an at least substantially semi-oval exterior geometry, wherein the blade guiding unit further comprises at least one fiber directing element, which is implemented at least partly of an inorganic-fiber compatible material and comprises at least one rounded fiber guiding edge.

A "guiding device for a material to be wound" is in particular to mean, in this context, at least a component and/or a sub-assembly of a winding machine. In particular, for the purpose of carrying out a winding process, the guiding device for a material to be wound is arranged—function-wise or location-wise—between a feed unit for material to be wound and a carrier of material to be wound of the winding machine. By a "winding process" is in particular, in this context, a process to be understood in which a material to be wound is wound onto the carrier of material to be wound. A "feed unit for material to be wound" is herein in particular to mean a unit which is configured for making the material to be wound available and in particular for feeding the material to be wound to the guiding device for a material to be wound. "Configured" is in particular to mean specifically programmed, designed and/or equipped. By an object being configured for a certain function is in particular to be understood that the object fulfills and/or implements said certain function in at least one application state and/or operation state. By a "material to be wound" is in particular a windable material to be understood, which may in particular be wound up for storage and/or for transport and/or for further processing. Furthermore, a "carrier of material to be wound" is in particular to mean a carrier and/or body which is configured for receiving the material to be wound, in particular on an exterior surface. Preferably the carrier of material to be wound is embodied as a tube, in particular as a hollow body, preferably as a hollow cylinder, in particular having an annulus-shaped base area. Alternatively, however, it is also conceivable that a carrier of material to be wound is embodied as a full body, in particular as a full cylinder.

By a "blade guiding unit" is in particular, in this context, a unit to be understood which is configured for guiding a material to be wound during a winding process in such a way that the material to be wound is wound onto the carrier of material to be wound to form a cross-wound bobbin. For this purpose the blade guiding unit comprises two fiber guiding blades which are rotationally drivable in opposite directions. the fiber guiding blades are in particular arranged in such a way that they are spaced apart from each other in a direction extending perpendicularly to their rotational planes. The rotational planes of the fiber guiding blades extend, in particular at least substantially, parallel to each other and preferably precisely parallel to each other. By "at least substantially parallel" is in particular an orientation of a direction with respect to a reference direction, in particular in a plane, to be understood, wherein the direction has a deviation from the reference direction of maximally 5 degrees, preferably maximally 2.5 degrees, advantageously maximally 1 degree and especially advantageously maximally 0.5 degrees. The two fiber guiding blades are in particular configured for traversing the material to be wound on the carrier of material to be wound respectively in lifting directions which are oriented opposite to each other. A reversal of a lifting direction is in particular respectively effected by a transfer of the material to be wound between the fiber guiding blades in a motion reversal point.

By "inorganic fibers" are in particular, in this context, industrially produced and formed materials to be understood which are made of substances like carbon, metals and/or metalloids or their oxides or carbides. The inorganic fibers preferably have a cylindrical shape. Preferentially the material to be wound is implemented of glass fibers or basalt fibers. The inorganic fibers may be obtained in particular by direct drawing of the inorganic fibers from a respective material melt. In particular, the material to be wound may consist of a plurality of parallel-running inorganic fibers. By the blade guiding unit "conveying" the material to be wound, which is implemented of inorganic fibers, is in particular to be understood, in this context, that the blade guiding unit feeds the inorganic fibers, which have in particular been drawn directly from a material melt, to the carrier of material to be wound in an alternating motion along the lifting directions of the fiber guiding blades for the purpose of creating a cross-wound bobbin.

By such an implementation a generic guiding device for a material to be wound can be provided which has improved characteristics in regard to guiding inorganic fibers. In particular, by using a blade guiding unit a winding, in particular a winding to form a cross-wound bobbin, of a material to be wound which is implemented of inorganic fibers may be effected at an advantageously high velocity of material to be wound, as a result of which an advantageously short time period is achievable for implementing a winding process.

It is further proposed that the fiber guiding blades are implemented at least partly of an inorganic-fiber compatible material. In particular, the fiber guiding blades may also be entirely implemented of the inorganic-fiber compatible material. By an "inorganic-fiber compatible material" is in particular, in this context, a material to be understood the abrasion resistance of which is at least equivalent to an abrasion resistance of the inorganic fiber, in particular of the material to be wound that is implemented of the inorganic fiber. In particular, an abrasion resistance of the inorganic-fiber compatible material is smaller than the abrasion resistance of the inorganic fiber, in particular than the abrasion resistance of the material to be wound that is implemented of the inorganic fiber, by at least a factor of two, preferably at least by a factor of five, advantageously at least by a factor of ten and especially advantageously by a factor of twenty. In particular, abrasion powders and/or abrasion particles of the inorganic-fiber compatible material do not result in impermissible contamination of the material to be wound. This allows advantageously minimizing and/or preferably, at least to a large extent, preventing damages, in particular damages to the inorganic fibers, and/or contamination, in particular damages to the inorganic fibers.

In an implementation of the invention it is proposed that the blade guiding unit comprises at least one fiber guiding blade tip, which is implemented at least substantially by the inorganic-fiber compatible material. By a "fiber guiding blade tip" is in particular, in this context, an element to be understood which is configured to establish a physical contact between the respective fiber guiding blade and the material to be wound, for the purpose of guidance of the material to be wound via the fiber guiding blades. In particular, respectively two fiber guiding blade tips are arranged on respectively opposite extreme ends of the fiber guiding blades. In particular, the fiber guiding blade tips may be embodied in a one-part implementation with the fiber guiding blades. The term "in a one-part implementation" is in particular to mean connected at least by substance-to-substance bond, e.g. via a welding process, an adhesive-bonding process, an injection-molding process and/or another process deemed expedient by someone skilled in the art, and/or advantageously implemented in one piece, e.g. by production from a cast and/or by production in a one-component or multi-component injection molding process, and advantageously from a single blank. This allows keeping production costs advantageously low, as merely fiber guiding blade tips need to be produced of the inorganic-fiber compatible material.

In an advantageous implementation of the invention it is proposed that the fiber guiding unit comprises at least one exchangeable fiber guiding blade tip, which is made at least substantially of the inorganic-fiber compatible material. In particular, respectively two exchangeable fiber guiding blade tips are arranged on respectively opposite extreme ends of the fiber guiding blades. Preferably fiber guiding blade tips are connected to the respective fiber guiding blade via a non-destructively releasable, in particular force-fit and/or form-fit connection. This allows keeping production costs advantageously low. Furthermore, by fixating the fiber guiding blade tips to the fiber guiding blades in a releasable fashion, an advantageously simple and/or fast and/or cost-effective exchange of the fiber guiding blade tips may be rendered possible.

In particular, the fiber guiding blade tips may be coated with the inorganic-fiber compatible material. By the fiber guiding blade tips being "coated" is in particular to be understood, in this context, that the inorganic-fiber compatible material has been applied to a surface of the fiber guiding blade tips as a firmly adherent layer. In particular, the inorganic-fiber compatible material may have been applied as one layer or as a plurality of layers which are in connection with each other. In particular, a coating of the fiber guiding blade tips may be effected via a chemical and/or mechanical and/or thermal and/or thermomechanical procedure, in particular depending on the inorganic-fiber compatible material. This allows achieving advantageously low material costs.

In particular, viewed in a rotational plane of a fiber guiding blade, the fiber guiding blade tip has an at least substantially semi-oval exterior geometry. In particular, the fiber guiding blade tip is at least substantially free of in particular angular edges, in particular in a contact zone which is swept over by the material to be wound during conveyance by the fiber guiding blade tip. In particular, a fiber guiding blade tip may have an at least substantially semi-elliptic or parabola-shaped exterior geometry. By "at least substantially semi-elliptic" is in particular to be understood, in this context, that an exterior geometry of a fiber guiding blade tip deviates from a semi-ellipse in particular by less than 25%, preferably by less than 10% and particularly preferably by less than 5%. By "at least substantially parabola-shaped" is in particular to be understood, in this context, that an exterior geometry of a fiber guiding blade tip deviates from a parabola in particular by less than 25%, preferably by less than 10% and particularly preferably by less than 5%. This advantageously allows avoiding that the material to be wound is undone, in particular that individual inorganic fibers of a strand of material to be wound are separated off.

By a "fiber directing element" is in particular, in this context, an element to be understood which extends, in particular at least substantially in an arc-shaped fashion, between the motion reversal points of the fiber guiding blades. In particular, the material to be wound is conveyed respectively along the fiber directing element by means of the fiber guiding blades. In particular, the fiber directing element may be arranged beneath the fiber guiding blades. Alternatively, it is however also conceivable that the fiber directing element is arranged above or between the fiber guiding blades. It is moreover also conceivable that the blade guiding unit comprises two fiber directing elements, wherein a first fiber directing element is arranged above the fiber guiding blades and a second fiber directing element is arranged beneath the fiber guiding blades. This allows achieving an advantageous guidance of the material to be wound while avoiding at the same time damages and/or impermissible contamination of the material to be wound.

In particular, the rounded fiber guiding edge runs at least substantially perpendicularly to a feed direction of the material to be wound. In particular, the rounded fiber guiding edge runs at least substantially in parallel to a rotational plane of a fiber guiding blade. The rounded fiber guiding edge extends in particular at least substantially over an entire length of the fiber directing element. In particular, a deflection of the material to be wound is effected via the rounded fiber guiding edge. The material to be wound is in physical contact to the fiber directing element in particular only in a region of the rounded fiber guiding edge. This allows advantageously avoiding damages to the material to be wound.

In a further implementation of the invention it is proposed that the at least one blade guiding unit comprises at least one fiber directing element, wherein the material to be wound runs at least substantially tangentially to a rounded fiber guiding edge of the fiber directing element at least in an inlet contact point. By an "inlet contact point" is in particular, in this context, a point to be understood in which, viewed along an extension direction of the material to be wound, there is a first physical contact between the material to be wound and the rounded fiber guiding edge. In this way an advantageously smooth feeding of the material to be wound onto the rounded fiber guiding edge is achievable.

In a further implementation of the invention it is proposed that the at least one blade guiding unit comprises at least one fiber directing element, wherein the material to be wound runs at least substantially tangentially to a rounded fiber guiding edge of the fiber directing element in an outlet contact point. By an "outlet contact point" is in particular, in this context, a point to be understood in which, viewed along an extension direction of the material to be wound, there is a last physical contact between the material to be wound and the rounded fiber guiding edge. In this way an advantageously smooth release of the material to be wound from the rounded fiber guiding edge is achievable.

In a preferred implementation of the invention it is proposed that the inorganic-fiber compatible material is a phenolic resin compound, e.g. fiber-reinforced synthetic material or a hard tissue. This allows advantageously minimizing and/or preferably at least largely preventing damages, in particular damages to the inorganic fibers and/or impermissible contamination of the material to be wound.

In a further preferred implementation of the invention it is proposed that the inorganic-fiber compatible material is a soft metal, e.g. brass. This allows advantageously minimizing and/or preferably at least largely preventing damages, in particular damages to the inorganic fibers and/or impermissible contamination of the material to be wound.

In a further preferred implementation of the invention it is proposed that the inorganic-fiber compatible material is a plastics material. By a "plastics material" is, in this context, in particular a thermoplastic synthetic material to be understood, e.g. acrylonitrile butadiene styrene, a polyamide, polymethyl-methacrylate, a polycarbonate, polyethylene, polypropylene. This allows advantageously minimizing and/or preferably at least largely preventing damages, in particular damages to the inorganic fibers and/or impermissible contamination of the material to be wound.

It is also proposed that the guiding device for a material to be wound comprises a cleaning unit, which is configured for applying a cleaning fluid, in particular water, onto the blade guiding unit in at least one operating state. In particular, the cleaning unit is configured for cleaning the blade guiding unit, in particular between two consecutive winding processes. In particular, the cleaning unit is configured to at least largely remove manufacturing-related residue, in particular sizing. In this way advantageously reliable and/or fail-safe operation of the guiding device for a material to be wound is achievable.

Moreover a winding machine is proposed, with at least one guiding device for a material to be wound, as a result of which an advantageous winding of a material to be wound, which is implemented of inorganic fibers, may be rendered possible. In particular, the guiding device for a material to be wound may be arranged on a pivot arm that is supported pivotably with respect to a carrier of material to be wound, and/or on an arm of the winding machine that is supported in such a way that it is linearly displaceable with respect to a carrier of material to be wound. In this way during a winding process an advantageously simple and/or precise adaption of a position of the at least one guiding device for a material to be wound with respect to the carrier of material to be wound, in particular with respect to an increasing bobbin diameter, is achievable. In particular, the guiding device for a material to be wound is supported on the pivot arm in such a way that it is adjustable in a rotational position/orientation with respect to the carrier of material to be wound. This allows advantageously compensating a changed orientation of the guiding device for a material to be wound with respect to the carrier of a material to be wound, which change is, in particular, due to a pivoting motion of the pivot arm.

Further a method is proposed for winding a material to be wound, which is implemented of inorganic fibers, by means of a guiding device for a material to be wound, as a result of which advantageous winding of a material to be wound, which is implemented of inorganic fibers, may be rendered possible.

The guiding device for a material to be wound according to the invention is herein not to be restricted to the application and implementation described above. In particular, the guiding device for a material to be wound according to the invention may comprise, for fulfilling a functionality herein described, a number of respective elements, structural components and units that differs from a number that is herein mentioned.

DRAWINGS

Further advantages may become apparent from the following description of the drawings. The drawings show an exemplary embodiment of the invention. The drawings, the description and the claims contain a plurality of features in combination. Someone having ordinary skill in the art will purposefully also consider the features separately and will find further expedient combinations.

It is shown in:

FIG. 1 a winding machine with a guiding device for a material to be wound, in a front view, FIG. 2 the guiding device for a material to be wound with two blade guiding units, in a perspective view from below, FIG. 3 the guiding device for a material to be wound with two blade guiding units, in a perspective view from above, FIG. 4 a fiber directing element and a fiber guiding blade of the guiding device for a material to be wound in a plan view, and FIG. 5 a simplified lateral view showing a fiber guiding blade, a fiber directing element and a carrier of material to be wound.

DESCRIPTION OF THE EXEMPLARY EMBODIMENT

FIG. 1 shows an exemplary winding machine 12 for winding a material to be wound 26, which is implemented of inorganic fibers, in a front view. Preferably the winding machine 12 is configured for winding a material to be wound 26 which is made of glass fibers or basalt fibers. The winding machine 12 comprises a winding machine housing 54. The winding machine 12 further comprises a winding unit 56. For the purpose of controlling an operation of the winding machine 12, the winding unit 56 comprises a control unit (not shown). The control unit comprises a computing unit, a storage unit and an operating program which is stored in the storage unit and is configured to be carried out by the computing unit.

The winding unit 56 comprises two winding mandrels 58, 60. The winding mandrels 58, 60 are each embodied cylinder-shaped. The winding mandrels 58, 60 are, for example, made of high-grade steel and/or aluminum. The winding mandrels 58, 60 are furthermore embodied rotatable. The winding mandrels 58, 60 are each supported in such a way that they are rotatable about a winding axis 62, 64. The winding mandrels 58, 60 are respectively embodied as clamping mandrels. The winding mandrels 58, 60 thus each comprise a plurality of clamping jaws (not shown). The winding mandrels 58, 60 are in at least one operating state configured to support respectively one carrier of material to be wound 22, 24 via a force-fit connection. Moreover the winding unit 56 comprises a drive unit (not shown). The drive unit is configured to set the winding mandrels 58, 60 into rotational motion during a winding process, and to confer the torque thus produced to the carriers of material to be wound 22, 24. The winding mandrels 58, 60 are arranged on a turntable 66. The turntable 66 is configured to effect, between two winding processes, a position change of the two winding mandrels 58, 60. Thus a winding process takes place only on one of the winding mandrels 58, 60 respectively, while a change of carriers of material to be wound 22, 24 may be carried out on the respectively other one of the winding mandrels 58, 60.

Furthermore the winding machine 12 comprises a guiding device for a material to be wound 10, which is configured to feed the material to be wound 26, which is implemented of inorganic fibers, preferably of glass fibers or basalt fibers, to the respective carrier of material to be wound 22, 24. The guiding device for a material to be wound 10 is arranged on a pivot arm 68 of the winding machine 12. The pivot arm 68 is arranged inside the winding machine housing 54 and is hence only slightly indicated in the drawing. During a winding process the pivot arm 68 is pivotable about a pivot point relative to the carrier of material to be wound 22, 24 respectively participating in the winding process. The pivot arm 68 is configured for changing a position of the guiding device for a material to be wound 10 relative to the carrier of material to be wound 22, 24 depending on a bobbin diameter, which increases during the winding process. For the purpose of compensating a change in orientation of the guiding device for a material to be wound 10 relative to the carrier of material to be wound 22, 24 caused by a pivoting of the pivot arm 68, the guiding device for a material to be wound 10 is supported on the pivot arm 68 in a rotational position 72 in such a way that it is adjustable with respect to the carrier of material to be wound.

Figure 2:
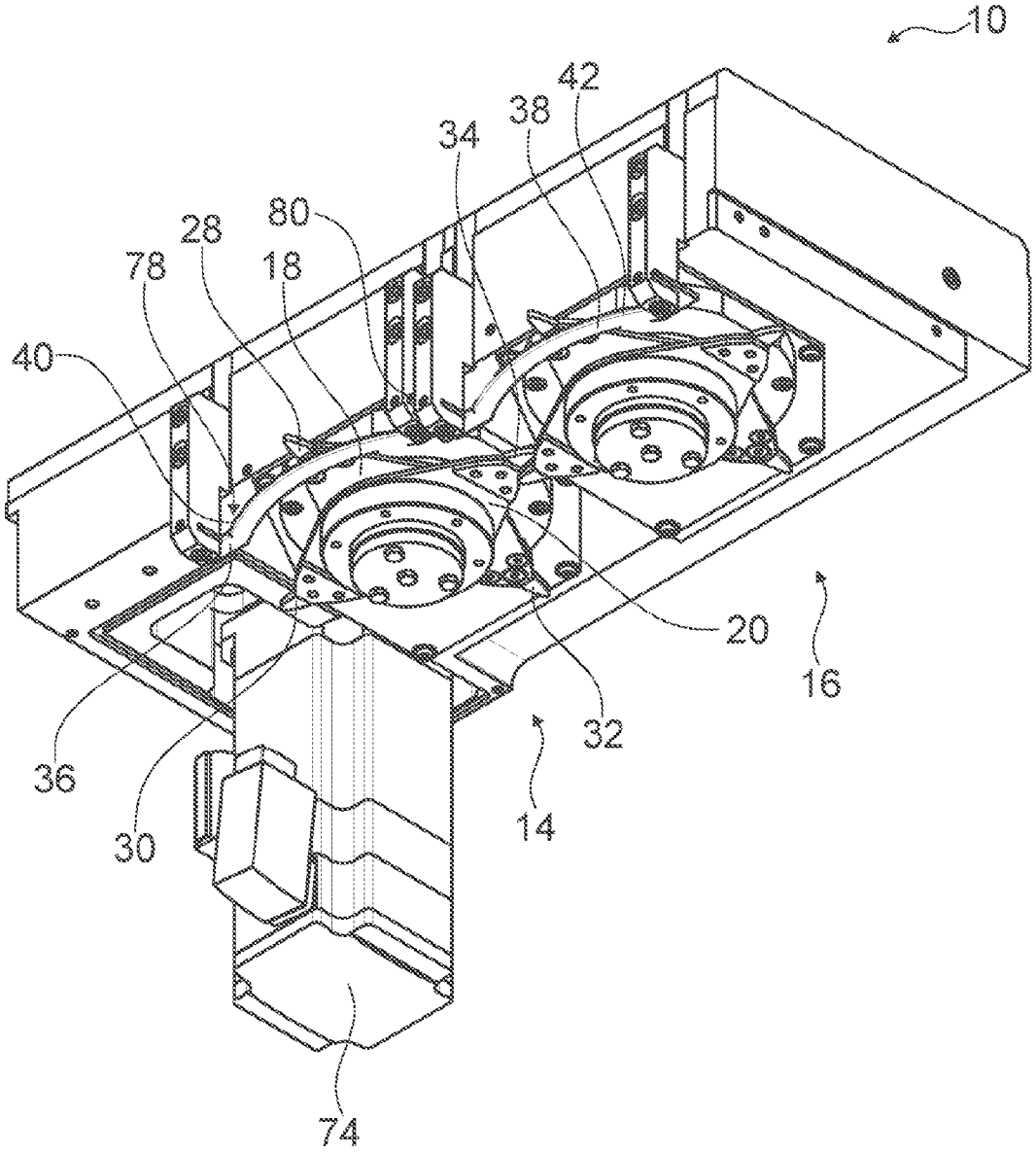

FIG. 2 shows the guiding device for a material to be wound 10 in a perspective view from below. FIG. 3 shows the guiding device for a material to be wound 10 in a perspective view from above. In FIG. 3 the guiding device for a material to be wound 10 is shown without an upper housing cover. The guiding device for a material to be wound 10 here comprises, as an example, two blade guiding units 14, 16, which are embodied identically to each other. A drive of the blade guiding units 14, 16 is effected, for example, via an electro-motoric drive 74, which is coupled with the blade guiding units 14, 16 via a drive train 76, which is in this case embodied, as an example, as a belt drive (cf. FIG. 3). The blade guiding units 14, 16 are embodied identically to each other. For better overview, only one of the blade guiding units 14, 16 has been given reference numerals. The following description respectively applies to all blade guiding units 14, 16. The blade guiding units 14, 16 respectively comprise two fiber guiding blades 18, 20, which are rotationally drivable in opposite directions and are configured for feeding the material to be wound 26, which is implemented of inorganic fibers, to the carrier of material to be wound 22, 24 of the winding machine 12. The fiber guiding blades 18, 20 are in particular configured for traversing the material to be wound 26 on the carrier of material to be wound 22, 24, in a manner known to someone having ordinary skill in the art, respectively in lifting directions which are oriented opposite to each other, for the purpose of creating a cross-wound bobbin. A lifting direction reversal is in particular effected by transfer of the material to be wound 26 between the fiber guiding blades 18, 20 in a motion reversal point 78, 80. For the purpose of acting counter to a damage and/or impermissible contamination of the material to be wound 26, thus avoiding waste, at least to a large extent, the fiber guiding blades 18, 20 are embodied partly of an inorganic-fiber compatible material. The blade guiding units 14, 16 comprise fiber guiding blade tips 28, 30, 32, 34, which are embodied at least substantially of the inorganic-fiber compatible material. The fiber guiding blade tips 28, 30, 32, 34 are arranged on extreme ends of the fiber guiding blades 18, 20. The fiber guiding blade tips 28, 30, 32, 34 are connected to the fiber guiding blades 18, 20 via a non-destructively releasable connection, e.g. via a screw connection. The inorganic-fiber compatible material in particular has an abrasion resistance that is at least equal to, preferably many times smaller than an abrasion resistance of the material to be wound 26 which is implemented of inorganic fibers. Preferentially the inorganic-fiber compatible material is a phenolic resin compound, a soft metal or a plastics material.

Besides the fiber guiding blades 18, 20 the blade guiding units 14, 16 each comprise a fiber directing element 36, 38. The fiber directing elements 36, 38 extend in arc-shaped fashion between the motion reversal points 78, 80 of the fiber guiding blades 18, 20. The material to be wound 26 is guided respectively along the fiber directing elements 36, 38 by the fiber guiding blades 18, 20. To act counter to damage and/or impermissible contamination of the material to be wound 26, thus avoiding waste at least to a large extent, the fiber directing elements 36, 38 are embodied partly of the inorganic-fiber compatible material or are coated with the inorganic-fiber compatible material.

Figure 3:
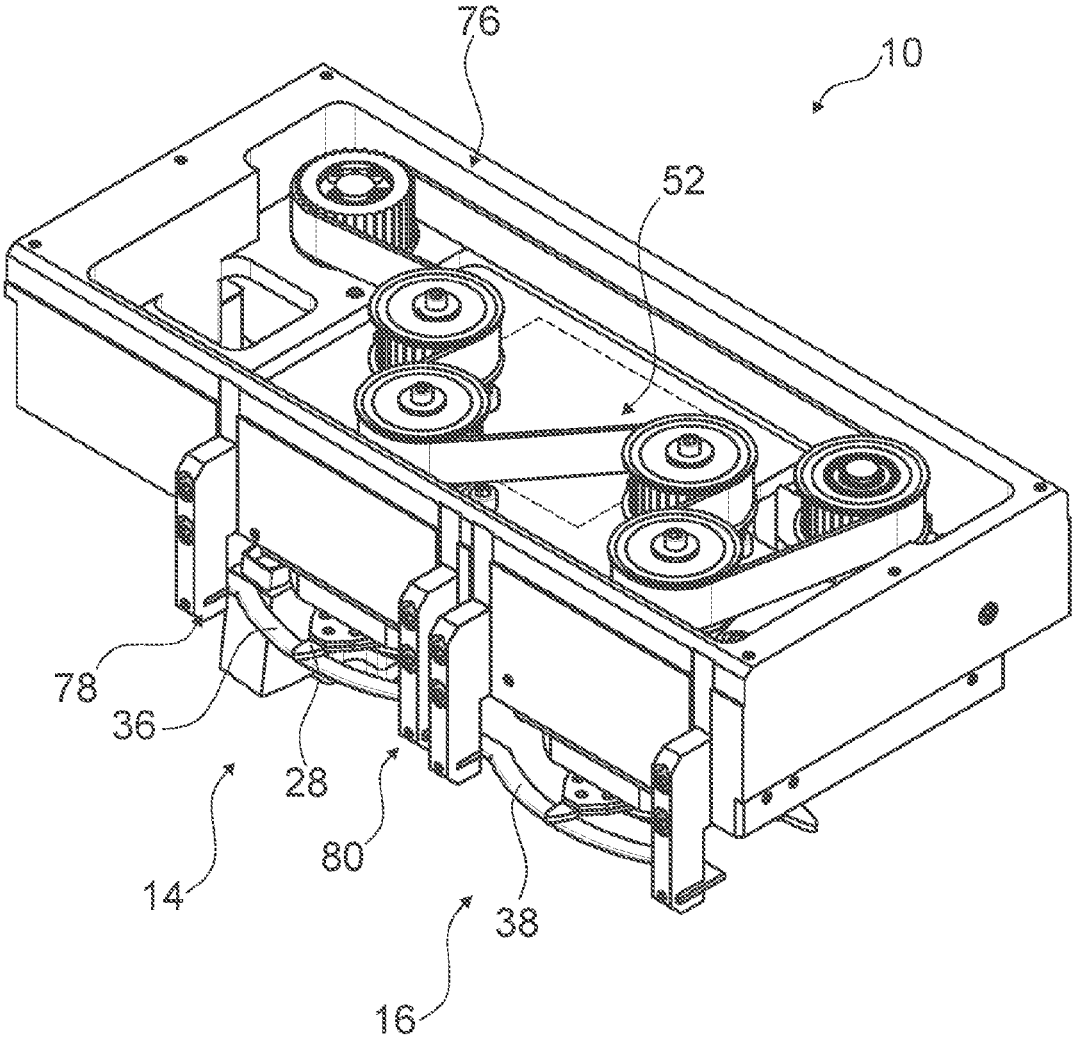

The guiding device for a material to be wound 10 further comprises a cleaning unit 52, which is configured for applying a cleaning fluid onto the blade guiding unit 14, 16 in at least one operating state (shown in FIG. 3 in only slightly indicating fashion). In particular, the cleaning unit 52 is configured to remove sizings from the blade guiding units 14, 16. Sizings are wetting fluids which are applied onto the material to be wound 26 during production. The sizings are intended, among other purposes, to protect the inorganic fibers of the material to be wound 26, in particular to prevent them from being damaged by mutual friction and/or by friction with machine parts by abrasion, and to prevent cross-fragmentation in case of mechanical impact. The sizings are furthermore configured to improve a smoothness of the material to be wound 26 and to reduce mutual friction of the filaments. Sizing residue may lead to movable parts being glued with each other, in particular during a standstill of the blade guiding units 14, 16, which may result in dysfunction and/or breakdown of the guiding device for a material to be wound 10. To prevent undesired application of the cleaning fluid onto the material to be wound 26, cleaning of the blade guiding units 14, 16 is preferably carried out between two consecutive winding processes, in particular during a position change of the two winding mandrels 58, 60.

Figure 4:
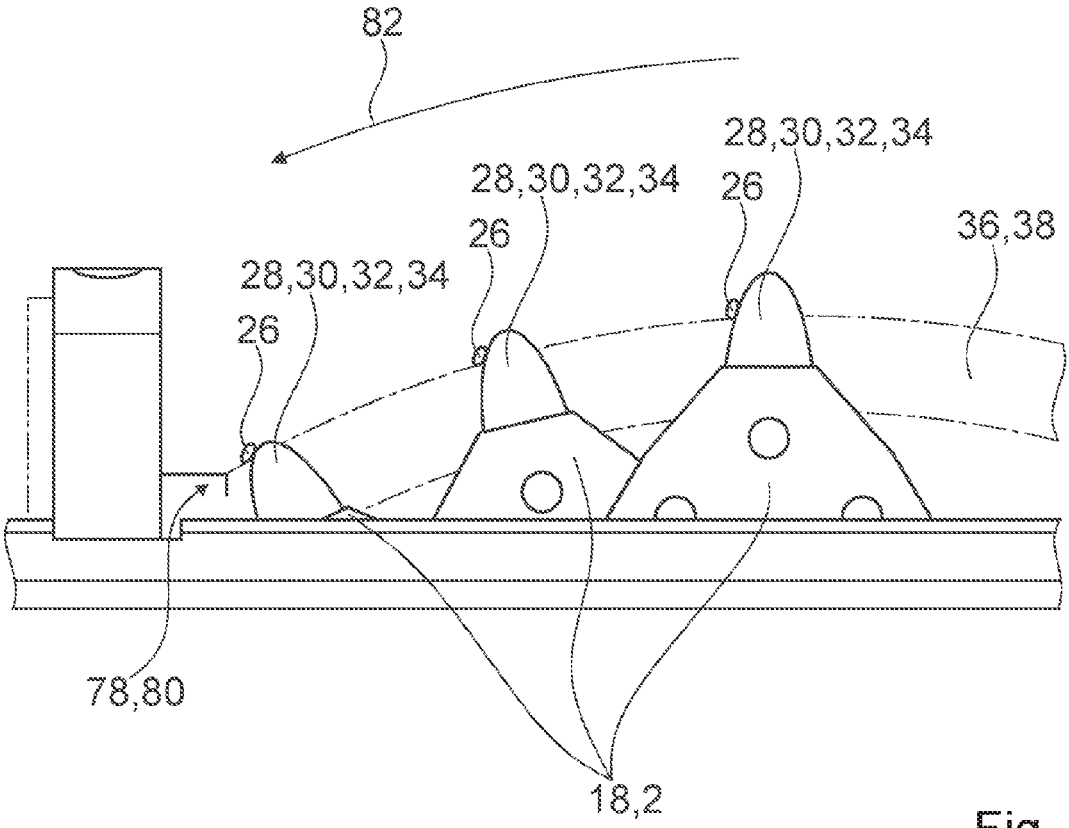

FIG. 4 shows one of the fiber directing elements 36, 38 as well as one of the fiber guiding blades 18, 20 in a plan view. The fiber guiding blade 18, 20 is exemplarily shown in three positions during a rotation 82. The fiber guiding blade tip 28, 30, 32, 34 comprises a semi-oval exterior geometry. In a movement of the fiber guiding blade 18, 20, a cross-section of the material to be wound 26, which is implemented of a plurality of parallel-oriented inorganic fibers, is deformed to an oval by the fiber guiding blade tip 28, 30, 32, 34. During the rotation 82 of the fiber guiding blade 18, 20, the material to be wound 26 moves along the exterior geometry of the fiber guiding blade tip 28, 30, 32, 34. In this an orientation of the oval cross section of the material to be wound 26 towards a motion reversal point 78, 80 changes by at least substantially 90 degrees. As a result of this, fanning-out of the material to be wound 26, in particular individual inorganic fibers separating off, is preventable at least to a large extent.

Figure 5:
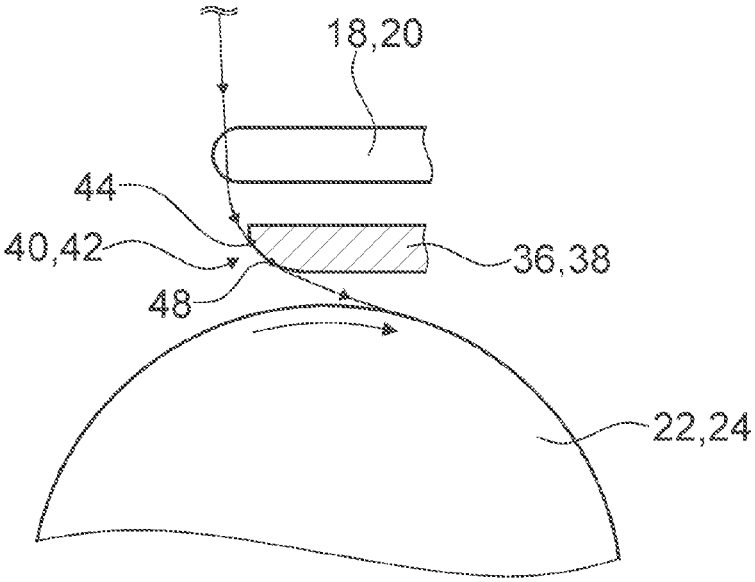

FIG. 5 shows a simplified lateral view of a fiber guiding blade 18, 20, of a fiber directing element 36, 38 and of a carrier of material to be wound 22, 24. The material to be wound 26 is conveyed along the fiber directing element 36, 38 and wound onto the rotating carrier of material to be wound 22, 24 by the fiber guiding blade 18, 20. The fiber directing element 36, 38 is arranged below the fiber guiding blade 18, 20. The fiber directing element 36, 38 comprises a rounded fiber guiding edge 40, 42. In an inlet contact point 44, the material to be wound 26 extends at least substantially tangentially to the rounded fiber guiding edge 40, 42 of the fiber directing element 36, 38. In an outlet contact point 48, the material to be wound 26 extends at least substantially tangentially to the rounded fiber guiding edge 40, 42 of the fiber directing element 36, 38.

The invention claimed is:

1. A guiding device for a material to be wound for a winding machine, with at least one blade guiding unit comprising two fiber guiding blades, which are rotationally drivable in opposite directions and are configured for feeding the material to be wound to a carrier of material to be wound of the winding machine, wherein the at least one blade guiding unit is configured for conveying the material to be wound which is implemented of inorganic fibers, wherein the blade guiding unit comprises at least one fiber guiding blade tip, which has an at least substantially semi-oval exterior geometry, wherein the blade guiding unit further comprises at least one fiber directing element, which is implemented at least partly of an inorganic-fiber compatible material and has at least one rounded fiber guiding edge.

2. The guiding device for a material to be wound according to claim 1, wherein the fiber guiding blades are implemented at least partly of an inorganic-fiber compatible material.

3. The guiding device for a material to be wound according to claim 1, wherein the blade guiding unit comprises at least one fiber guiding blade tip, which is implemented at least substantially of the inorganic-fiber compatible material.

4. The guiding device for a material to be wound according to claim 1, wherein the blade guiding unit comprises at least one exchangeable fiber guiding blade tip, which is implemented at least substantially of the inorganic-fiber compatible material.

5. The guiding device for a material to be wound according to claim 1, wherein the at least one blade guiding unit comprises at least one fiber directing element, wherein the material to be wound runs at least substantially tangentially to a rounded fiber guiding edge of the fiber directing element at least in an inlet contact point.

6. The guiding device for a material to be wound according to claim 1, wherein the at least one blade guiding unit comprises at least one fiber directing element, wherein the material to be wound runs at least substantially tangentially to a rounded fiber guiding edge of the fiber directing element at least in an outlet contact point.

7. The guiding device for a material to be wound according to claim 1, wherein the inorganic-fiber compatible material is a phenolic resin compound.

8. The guiding device for a material to be wound according to claim 1, wherein the inorganic-fiber compatible material is a soft metal.

9. The guiding device for a material to be wound according to claim 1, wherein the inorganic-fiber compatible material is a plastics material.

10. The guiding device for a material to be wound according to claim 1, comprising a cleaning unit, which is configured for applying a cleaning fluid onto the blade guiding unit in at least one operating state.

11. A winding machine with at least one guiding device for a material to be wound according to claim 1.

* * * * *